United States Patent [19]

Maxson et al.

[11] Patent Number: 4,768,455

[45] Date of Patent: Sep. 6, 1988

[54] DUAL WALL STEEL AND FIBER COMPOSITE MOORING ELEMENT FOR DEEP WATER OFFSHORE STRUCTURES

[75] Inventors: Orwin G. Maxson; Robert D. Ohmart; Marvin L. Peterson, all of Ponca City, Okla.

[73] Assignee: Conoco Inc., Ponca City, Okla.

[21] Appl. No.: 45,910

[22] Filed: Apr. 30, 1987

Related U.S. Application Data

[63] Continuation of Ser. No. 689,113, Jan. 7, 1983, abandoned.

[51] Int. Cl.[4] ..... B63B 35/44

[52] U.S. Cl. ..... 114/264; 405/224; 114/265; 114/294; 138/140; 285/239

[58] Field of Search ..... 114/293, 294, 230, 264, 114/265; 405/200, 202, 224, 195; 175/5-8; 166/352, 367, 354, 359, 357; 138/140, 153, 141, 172, DIG. 2; 285/149, 174, 238, 239; 52/725, 727, 728, 730

[56] References Cited

U.S. PATENT DOCUMENTS

| | | | |
|---|---|---|---|
| 3,768,842 | 10/1973 | Ahlstone | 166/367 |
| 4,114,393 | 9/1978 | Engle, Jr. et al. | 114/264 |
| 4,297,965 | 11/1981 | Horton et al. | 114/265 |
| 4,530,379 | 7/1985 | Policelli | 285/149 |

*Primary Examiner*—Sherman D. Basinger
*Assistant Examiner*—Edwin L. Swinehart
*Attorney, Agent, or Firm*—Richard K. Thomson

[57] ABSTRACT

A composite structure of lightweight is used as a tensioned tether element for mooring of offshore facilities. The composite structure comprises bonded inner and outer tubular members having an annular space therebetween. Aramid or other fibrous, high strength material is bonded to the inner surface of the outer tubular member to provide additional tensile strength thereto. The remainder of the annulus between the inner and outer tubing may be filled with a foam material such as polyurethane foam. The composite structure can be made so as to be of neutral, positive or negative buoyancy. The composite allows greater tensile loadings than steel materials by themselves at greatly reduced weight.

17 Claims, 1 Drawing Sheet

DUAL WALL STEEL AND FIBER COMPOSITE MOORING ELEMENT FOR DEEP WATER OFFSHORE STRUCTURES

This is a continuation, of application Ser. No. 689,113 filed Jan. 7, 1983, now abandoned.

This invention relates to the art of floating offshore structures such as tension leg platforms and, more particularly, to a lightweight, steel and fiber composite structure for use as a mooring element for such offshore structures.

BACKGROUND OF THE INVENTION

With the gradual depletion of subterranean and shallow subsea hydrocarbon reservoirs, the search for additional petroleum reserves is being extended to deeper and deeper waters on the outer continental shelves of the world. As such deeper reservoirs are discovered, increasingly complex and sophisticated production systems have been developed. It is projected that by the year 1990, offshore exploration and production facilities will be required for probing depths of 6,000 feet or more. Since bottom founded structures are generally limited to water depths of no more than about 1,500 feet by current technology and because of the shear size of the structure required, other, so called compliant structures have been developed.

One type of compliant structure receiving considerable attention is a tension leg platform (TLP). A TLP comprises a semisubmersible-type floating platform anchored by piled foundations through vertically oriented members or mooring lines called tension legs. The tension legs are maintained in tension at all times by insuring that the buoyancy of the TLP exceeds its operating weight under all environmental conditions. The TLP is compliantly restrained in the lateral directions allowing sway, surge and yaw while vertical plane movement of heave, pitch and roll are stiffly restrained by the tension legs.

Several aspects of the design of the compliant structure concept are developed from dynamic considerations of the structure due to excitation by water waves. To minimize sway motions, the natural sway period of the structure must be either less than or greater than the wave periods at the various sea states. A stiff structure such as a fixed platform is designed with a natural sway period which is less than the wave period. However, the natural sway period of fixed platforms increases with increasing water depths and ultimately approaches the wave period resulting in large platform motions. In a compliant structure such as a TLP, the natural sway period is designed to be greater than the wave period.

Current TLP designs utilize heavy walled steel tubulars for the mooring elements. These tension legs constitute a significant weight with respect to the floating platform, a weight which must be overcome by the buoyancy of the floating structure. For instance, the tension legs utilized on the world's first commercial TLP which has been installed in the Hutton Field of the United Kingdom North Sea in 485 feet of water comprise steel tubulars having an outer diameter of 10.5 inches and an inner bore diameter of 3.0 inches. It should be readily apparent that, with increasingly long mooring elements being required for a tension leg platform in deeper and deeper waters, a floating structure having the necessary buoyancy to overcome the extreme weight of such mooring elements must be so large as to be uneconomic. Further, the handling equipment for installing and retrieving the long, heavy tension legs adds excessive weight and complexity to a tension leg platform system. Floatation systems can be utilized but their reliability is questionable. In addition, they cause an increase in the hydrodynamic forces on the structure.

In an effort to lower the weight of deep water tension legs while retaining the strength of the heavy steel tubulars, it has been proposed that high modulus composite structures of carbon fiber and/or aramid fiber be employed. While there is a significant reduction in the weight of such composite tension legs, composite structures are susceptible to impact damage. Furthermore, the high cost of the raw materials renders the use of composites extremely expensive and, thus, uneconomic for any installation other than to produce a large subsea oil bearing structure or in very deep waters.

SUMMARY OF THE INVENTION

The present invention provides a steel and fiber composite structure for use as a tensioned mooring element in a tension leg platform which can be made neutrally buoyant in water. Such structure is lighter in weight than current heavy-walled steel tubulars but has improved damage resistance and lower cost when compared to fiber reinforced composites.

In accordance with the invention, an assembly for use in a tensioned mooring element for a floating offshore structure comprises inner and outer metallic tubular members which are fixedly attached to each other at their ends and which define an annular space therebetween. The outer tubular member has an inner wall defining the annular space and a plurality of generally longitudinally oriented fibrous materials in a resin matrix are bonded to the inner surface of the outer tubular member for increasing its tensile strength.

Further in accordance with the invention, the above described assembly further includes syntactic foam filling the remainder of the defined annular space to insure the buoyancy of the assembly and provide additional rigidity and collapse resistance.

Still further in accordance with the invention, a plurality of the above described assemblies are attached in an end to end relationship and connected with a subsea anchor member and a floating platform and placed in tension to provide a tensioned mooring element for such floating platform.

It is therefore an object of this invention to provide a low cost, lightweight mooring element for floating offshore structures.

It is a further object of this invention to provide a lightweight, low cost mooring element which will permit the extension of tension leg platform technology to deeper waters than are currently economically possible utilizing tensioned mooring elements made solely from steel.

BRIEF DESCRIPTION OF THE DRAWINGS

These and other objects of the invention are accomplished through the manner and form of the present invention to be described hereinafter in the more limited aspects of a preferred embodiment thereof and illustrated in the accompanying drawings forming a part of this specification and in which.

DETAILED DESCRIPTION OF THE PREFERRED EMBODIMENTS AND THE DRAWINGS

Figure 1:
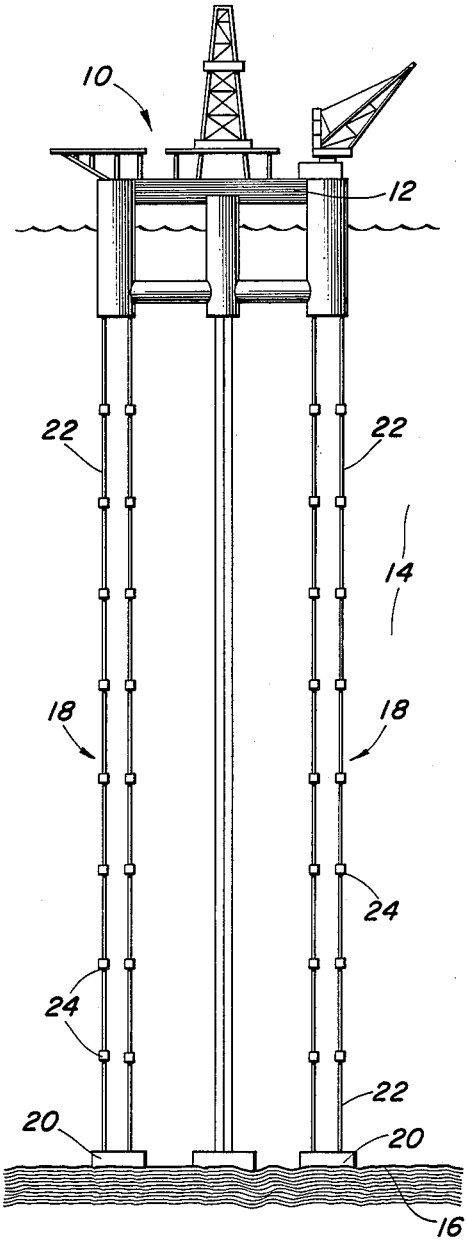
FIG. 1 is a schematic, side elevational view of a tension leg platform in which the hybrid composite mooring elements of the present invention may be incorporated.

Referring now to the drawings wherein several figures are presented for illustrating a preferred embodiment of the invention only and not for the purpose of limiting the scope of the invention, FIG. 1 shows an offshore tension leg platform 10. The TLP 10 generally comprises a platform 12 floating on a body of water 14 and which is anchored to the bottom 16 of the body of water by a plurality of tensioned mooring elements 18 which extend between the floating platform 12 and anchoring means 20 which are located on the bottom 16 of the body of water 14. The anchoring means 20 are adapted for connection of a plurality of tensioned mooring elements 18 and are secured in position by a plurality of pilings extending into the bottom 16.

In accordance with a preferred embodiment of the invention, the tensioned mooring elements 18 comprise a plurality of lightweight steel and fiber composite tubular assemblies 22 which are interconnected at their ends by a plurality of metallic connectors 24. The tensioned mooring elements 18 are maintained in constant tension between the anchoring 20 and the floating platform 12 by the buoyancy of the floating platform 12 which is constantialy maintained in excess of its operating weight under all conditions.

In accordance with the invention, the steel and fiber composite tubular assemblies 22 of the mooring elements 18 comprise a metallic outer tubular member 26 having a male threaded connector 28 on one end thereof and a female threaded connector 30 formed on its opposite end. The threaded connectors are provided for interconnection with other tubular assemblies 22. A second, smaller diameter tubular member 32 is concentrically disposed within the outer tubular member 26 and is attached thereto adjacent their end portions by welds 34, 36 adjacent the male and female connector portions 28, 30 respectively.

The concentric inner and outer tubular members 32, 26, respectively, form therebetween an annular space 36. In accordance with the invention, the outer wall 38 of the annular space 36 has bonded thereto a plurality of longitudinally oriented fibrous reinforcing members 40 in a resin matrix. In the preferred embodiment shown, longitudinally oriented aramid fibers are bonded together and to the outer wall 38 with an epoxy resin. The fibrous elements greatly increase the tensile strength of the tubular assembly 22. While aramid fibers are preferred due to their high tensile strength, other fibrous materials may be substituted or used in combination with the aramid fibers such as fibers of carbon, boron, glass, and the like. The amount and type of fibers used may be varied for each application so that the required load-bearing cross sectional area for the fibrous materials is provided within the annular space 36.

While bonding of the fibrous material 40 to the outer wall 38 of the annular space 36 may be sufficient to retain the fibers in a working relationship with the tubular assembly 22, upper and lower clamping members 42 and 44, respectively, may be provided to insure positive engagement of the fiber and resin composite 40 with the remainder of the structure of the tubular assembly 22. In the preferred embodiment shown in FIG. 2, the upper and lower clamping members 42, 44 extend so that they are welded to the structure in common with the outer tubular member 26 and the inner tubular member at welds 34.

In accordance with the yet another aspect of a preferred embodiment of this invention, the remaining portion of the annular space 36 is filled with a material to give additional rigidity and collapse resistance to the assembly 22. The annular space 36 may be filled with foam 46 of any type such as polyurethane foam, the density of which can be varied as it is foamed in place, polystyrene foam or an epoxy-hollow glass microsphere syntactic foam may be provided.

EXAMPLE

Figure 2:
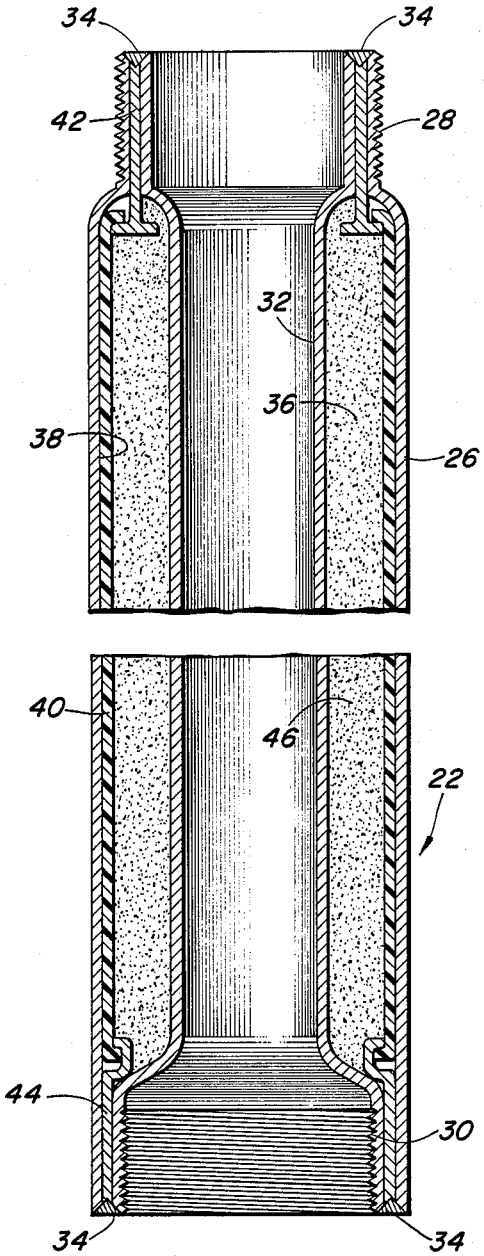
FIG. 2 is a cross sectional view of a mooring assembly in accordance with the present invention.

A composite assembly as shown in FIG. 2 is constructed utilizing an outer tubular member having a 24 inch O.D. and 0.25 inch wall thickness and an inner tubular member having a 10.75 inch O.D. and a 0.25 inch wall thickness. Kevlar aramid fiber is bonded to the inner surface of the outer tubular member. The remainder of the annular space is filled with one of the aforementioned rigid foam materials. If a tensile load is only carried by the steel portions of the structure and assuming the structure is loaded to a 50,000 psi yield strength, the tension compacity of the structure would be approximately 1,345,000 pounds. A composite member in accordance with this invention having 72 square inches (cross sectional area) of aramid fiber would have a tension copacity of 3.6 million pounds with the steel again loaded to its 50,000 psi yield strength. This is based on a modulus of elasticity for aramid fiber of 18,000,000 psi and the assumption that the portion of the axial load carried by each material is a function of the product of its area and its modulus of elasticity. The cross sectional area of each material can be optimized in the design process for each specific application.

The remainder of the annulus is filled with the foam having a weight density of 15 pounds per cubic foot. Using a weight density for aramid fiber of 90 pounds per cubic foot, the weight per foot of the composite assembly in air would be 164.7 pounds. The assembly would displace 164.4 pounds per foot in water with the interior of the tubular being flooded. Thus, the dual wall steel and fiber composite mooring element of this invention would have substantially neutral buoyancy in water.

While the inner and outer tubular members of the composite riser are preferably made of steel, other metals or composite materials may be used. Further, antifouling and/or cathodic protection coatings may be provided for the structure.

While the invention has been described in the more limited aspects of a preferred embodiment thereof, other embodiments have been suggested and still others will occur to those skilled in the art on a reading and understanding of the foregoing specification. It is intended that all such embodiments be included within the scope of this invention as limited only by the appended claims.

Having thus described our invention, we claim:

1. An assembly for use in a tensioned mooring element for a floating offshore structure comprising an inner metallic tubular member having end portions and an outer metallic tubular member having end portions, the end portions of each of said inner and outer metallic tubular members being welded to each other, said inner and outer tubular members defining an annular space therebetween and a plurality of longitudinally oriented fibrous materials bonded to an inner surface of said outer tubular member within said annular space, and further including clamping means for positively engaging the fibrous materials, said clamping means being fixedly attached to said inner and outer tubular members, whereby tensile strength of the assembly is increased.

2. An assembly for use in a tensioned mooring element for a floating offshore structure comprising an inner metallic tubular member having end portions and an outer metallic tubular member having end portions, the end portions of each of said inner and outer metallic tubular members being welded to each other, said inner and outer tubular members defining an annular space therebetween having a first length and a plurality of longitudinally oriented fibers having a second length which is substantially equal to said first length, said fibers being bonded to an inner surface of said outer metallic tubular member within said annular space whereby tensile strength of the assembly is increased.

3. The assembly as set forth in claim 2 wherein the inner and outer metallic tubular members are made of steel.

4. The assembly as set forth in claim 2 wherein said fibrous materials are disposed in a resin matrix which is bonded to said inner surface of said outer tubular member.

5. The assembly as set forth in claim 2 wherein said fibers comprise aramid fibers.

6. The assembly as set forth in claim 2 wherein said fibers comprise carbon fibers.

7. The assembly as set forth in claim 2 wherein said fibers comprise boron fibers.

8. The assembly as set forth in claim 2 wherein said fibers comprise glass fibers.

9. The assembly as set forth in claim 2 further including clamping means for positively engaging the fibers, said clamping means being fixedly attached to said inner and outer tubular members.

10. The assembly as set forth in claim 2 wherein said annular space also includes a rigid foam filler.

11. The assembly as set forth in claim 2 wherein said rigid foam filler comprises polyurethane foam.

12. The assembly as set forth in claim 10 wherein said rigid foam filler comprise polystyrene foam.

13. The assembly as set forth in claim 10 wherein said rigid foam filler comprises an epoxy-hollow glass microsphere syntatic foam.

14. A mooring tether extending between a subsea anchor means and a floating structure comprising an interconnected plurality of assemblies as set forth in claim 2.

15. In a tension leg platform wherein a floating structure is connected to anchor means located on a sea bottom by a plurality of tensioned, interconnected metallic tubular members, said tubular members comprising inner and outer concentric, cylindrical, load bearing metallic members each having end portions, the end portions being in a fixed attachment with each other, the concentric cylindrical members defining an annular space therebetween, the improvement which comprises said metallic tubular members being directly interconnected to each other as by welding and a reinforcing layer of longitudinally oriented fibers bonded to an inner surface of said outer concentric metallic cylindrical member within said annular space whereby tensile strength of the metallic tubular members is increased.

16. The improved tubular members as set forth in claim 15 further including clamping means for positively engaging end portions of said fibers, said clamping means being fixedly attached to said inner and outer concentric cylindrical members.

17. The improved tubular members as set forth in claim 16 wherein said clamping means include horizontally disposed land portions which cooperatively engage adjacent end portions of said fibers.

* * * * *

UNITED STATES PATENT AND TRADEMARK OFFICE

CERTIFICATE OF CORRECTION

PATENT NO. : 4,768,455

DATED : September 6, 1988

INVENTOR(S) : Orwin G. Maxson; Robert D. Ohmart; Marvin L. Peterson

It is certified that error appears in the above-identified patent and that said Letters Patent are hereby corrected as shown below:

On front sheet of patent, Application No. "45,910" should read --45,901--.

Signed and Sealed this

Fourteenth Day of February, 1989

*Attest:*

DONALD J. QUIGG

*Attesting Officer*

*Commissioner of Patents and Trademarks*